United States Patent [19]

Meyer

[11] 4,153,202

[45] May 8, 1979

[54] PART-CIRCLE SPRINKLER HEAD WITH IMPROVED QUICK-RETURN MECHANISM

[75] Inventor: Larry P. Meyer, Walla Walla, Wash.

[73] Assignee: Nelson Irrigation Corporation, Walla Walla, Wash.

[21] Appl. No.: 843,734

[22] Filed: Oct. 19, 1977

[51] Int. Cl.[2] ..... B05B 3/08

[52] U.S. Cl. ..... 239/230; 239/233

[58] Field of Search ..... 239/230, 231, 233

[56] References Cited

U.S. PATENT DOCUMENTS

| | | | |
|---|---|---|---|
| 1,811,171 | 6/1931 | Buckner | 239/231 |
| 2,649,268 | 8/1953 | Stein | 239/230 |
| 3,507,336 | 4/1970 | Nelson | 172/438 |
| 3,559,887 | 2/1971 | Meyer | 239/233 |
| 3,623,666 | 11/1971 | Meyer | 239/230 |
| 3,744,720 | 7/1973 | Meyer | 239/231 |

*Primary Examiner*—Robert W. Saifer

*Attorney, Agent, or Firm*—Cushman, Darby & Cushman

[57] ABSTRACT

A part-circle sprinkler head preferably of the pressure compensating quick return type in which the reactant structure on the reversing arm is provided with a coanda-effect surface which aids in moving the reactant structure into the stream. The mechanism for disengaging the reactant structure of the reversing arm from the stream minimizes reliance upon inertia to effect the disengagement function by utilizing a secondary reactant element. The spring mechanism which stably maintains the reversing arm in its inoperative position is interrelated with the reversing arm so that the torque applied thereto diminishes as the reversing arm moves toward its operative position within the stream.

41 Claims, 10 Drawing Figures

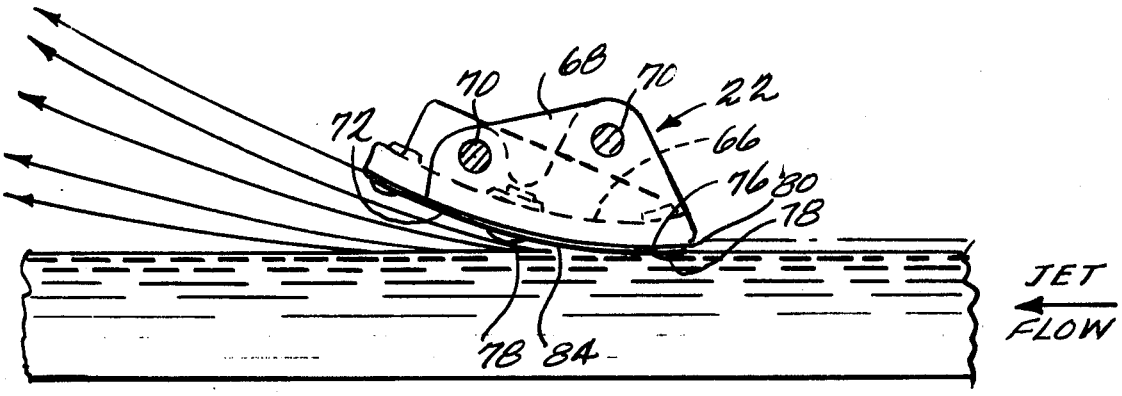
Fig. 6
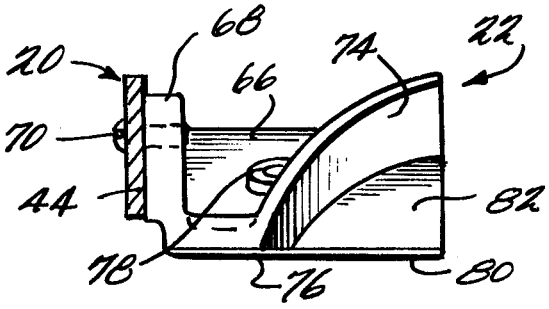
Fig. 7
Fig. 9
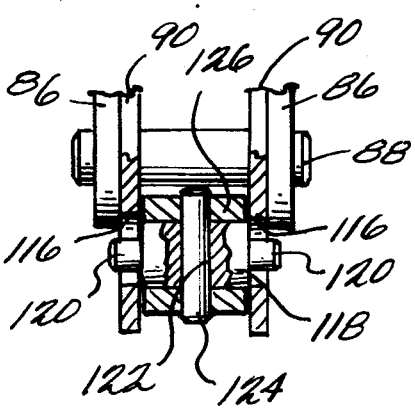
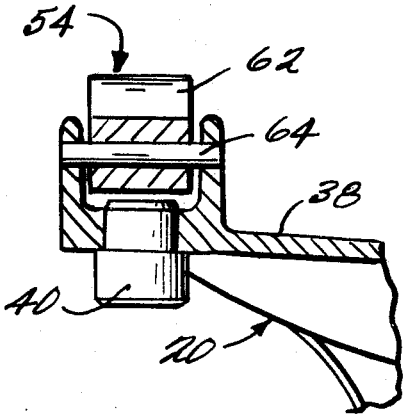
Fig. 10

PART-CIRCLE SPRINKLER HEAD WITH IMPROVED QUICK-RETURN MECHANISM

This invention relates to a sprinkler head and more particularly to high volume step-by-step rotary sprinkler heads of the part-circle type embodying quick return reversing mechanisms.

Sprinkler heads of the type herein contemplated have been long known in the prior art. An example of a sprinkler head of this type disclosed in the expired prior art is contained in U.S. Pat. No. 2,649,268. The quick return reversing mechanism disclosed in the above-identified patent is of a type similar to that disclosed in earlier prior art as, for example, U.S. Pat. No. 1,811,171. Reversing mechanisms of this type include a reversing arm mounted on the sprinkler body for movement between inoperative and operative positions. The reversing arm includes reversing reactant surfaces on the reversing arm which are disposed out of engagement of the stream issuing from the outlet of the sprinkler body when the reverse arm is in its inoperative position but which is engageable by the stream when the reverse arm is in its operative position to establish (1) a reversing resultant component force which acts through the reversing arm on the sprinkler body to effect a continuous reverse movement and (2) a reverse arm moving force component which acts on the reversing arm in a direction to move the same toward and into its operative position. The reversing mechanisms of the above patents each include a first adjustable stop adapted to be engaged during a predetermined incremental range of movement in the reversing direction to cause the reversing arm to be moved from its operative position to its inoperative position. In a like manner, a second adjustable stop is provided which is operable during a predetermined incremental range movement of the sprinkler head in its operative direction to cause the movement of the reversing arm from its inoperative position into its operative position.

In my prior commonly assigned U.S. Pat. No. 3,559,887, there are disclosed two specific improvements in these prior art quick return reversing mechanisms. First, a spring-bias was applied to the reversing arm which acted thereon to stably maintain the reversing arm in its inoperative position. This spring-bias improvement also insured that the sprinkler head could not be started up in reverse mode operation, with a shortened reverse stroke providing insufficient inertia to disengage the reversing arm from the stream. When the water to the sprinkler head is turned off at a time when the reversing mechanism is in its operative cycle, the shut-off of the water stream and disengagement thereof from the reactant surfaces on the reversing arm enabled the spring to bias the reversing arm from its operative position into its inoperative position. In this way, start-up would always take place in a normal operation mode with the reversing arm in its inoperative position.

The second improvement related to the provision of over-riding cams in lieu of the positive stops previously provided for effecting movement of the reversing arm between its inoperative and operative positions. These over-riding cams eliminated the possibility of the sprinkler head being subjected to severe impact loads when the sprinkler body reached the end of its reverse movement by eliminating the positive stopping of the momentum of the sprinkler body by the stops of the reversing mechanism itself.

A further improvement in the reversing mechanism is disclosed in my prior commonly assigned U.S. Pat. No. 3,623,666. This improvement relates to the provision of means for automatically compensating for changes in the energy level of the stream so as to maintain a generally constant reversing speed and hence a constant cycle speed. Where the reversing force is created by reactant surfaces which are fixed within the stream, the reversing force (and hence the reversing speed) was made to increase as the energy level of the stream increases. In order to achieve a more constant reversing speed and cycle speed throughout a wide range of stream energy levels, the portion of the reversing reactant element providing the reactant surface area for effecting the reversing movement is mounted on the reversing arm for resiliently biased pivotal movement so as to automatically compensate for changes in the energy level of the stream and thus produce a generally constant reversing force and speed. The resilient biased pivotal movement has the effect of resiliently yielding in response to an increase in the energy level of the stream above a relatively low value so as to deflect the stream through an angle which is proportionately less.

The quick return reversing mechanisms of the prior art function quite satisfactorily so long as the water pressure remains constant within a predetermined level and the water is turned on and off fairly rapidly. However, in certain types of systems utilizing such sprinkler heads, such as a pivot move agricultural irrigation system, the water pressures communicated with the sprinkler head vary widely because of terrain elevation changes. It is often the case that adjacent systems are on the same pump and when these systems are turned on and turned off, pressure variations will occur in the operation of the maintained sprinkler head. Because of the long supply lines involved, water pressures are brought up very slowly to prevent pipe rupture. Moreover, with increased emphasis on energy conservation, it has become more desirable to operate systems embodying sprinkler heads of the type herein contemplated at reduced energy levels.

One source of malfunction resulting from operation at lower energy levels occurs when the sprinkler head is initially moved into reverse operation and there is insufficient pressure to establish a reverse speed high enough to move the reversing arm out of its stream engaging operative position into its inoperative position. In all of the quick return reversing mechanisms previously provided, the inertia of the sprinkler head moving in its reverse direction is utilized as the event which effects the movement of the reversing arm from its operative position to its inoperative position. The inertia is utilized during the movement of the sprinkler head through the predetermined incremental range of movement determined by the position of the disengaging cam. The cam serves to transmit the incremental rotational movement of the sprinkler body directly into a corresponding movement of the reversing arm from its operative position into its inoperative position.

The forces necessary to effect this reversing arm movement are usually considerably greater than the resultant reactant force created on the reactant surface of the reversing arm when the energy level of the stream is near its minimum. Thus, the inertia forces stored in the moving arm provide the additional force required. In the absence of the necessary inertia movement, the reversing arm can reach a null position where the forces tending to move the sprinkler body in its reverse direction are balanced through the cam mechanism with the forces tending to maintain the reversing arm in its operative position. Under these circumstances, the sprinkler head tends to maintain itself in a single position resulting in large quantities of water engaging the same ground area in continuous fashion which can cause erosion and crop damage. The situation where the reversing mechanism causes the sprinkler head to maintain itself in a stationary balanced condition will not be cleared as the pressure is increased because the balanced forces are hydraulic forces which increase proportionately to any increase in water pressure.

Accordingly, it is an object of the present invention to provide an improved quick return reversing mechanism of the type described which obviates the type of malfunction noted above where the sprinkler head maintains itself in a single position because of the balancing of the hydraulic forces acting upon the reversing arm. In accordance with the principles of the present invention, this objective is obtained by eliminating the possibility of the hydraulic force balance from being established. Thus, rather than to directly transmit the reverse rotational movement of the sprinkler body through its predetermined incremental range of movement into a movement of the reversing arm from its operative position into its inoperative position, the initial portion of the range of movement is utilized to effect a material reduction in the resultant force component acting on the reversing arm while the latter is in its operative position. This reduction or change in reaction force component is accomplished by moving a secondary reactant vane or element into the path or movement of the stream. The engagement of the stream with the secondary vane or reactant element establishes an added reacting force component which renders it possible to effect movement of the reversing arm out of its operative position with far less inertial force than heretofore required. Indeed, preferably the force component reduction or change is greater than the opposite resultant reactant force component so that the resultant force component changes direction. In this way, the force required to move the secondary vane or reactant element into the path of movement of the stream can be of a magnitude significantly less than the reactant force tending to maintain the reversing arm in the stream. Once the secondary vane has been moved into a position to establish its reactive force, the resultant force of the stream on the reversing arm is in a direction to move the same out of the stream.

By providing for the accomplishment of reversing arm disengagement from the stream by an event which requires a significantly reduced actuation force and which eliminates the possibility of the balancing of hydraulic forces, not only are the problems of malfunction during start-up and low energy surges eliminated, but the range of energy levels at which a given sprinkler head can operate are materially increased. The increase in the range is at the low energy side where it is becoming more and more desirable to operate. Indeed, the lowering of the minimum force required to effect stream disengagement of the reversing arm achieved by the principles of the present invention enunciated above is sufficiently significant to create the need to lower the range of energy level at which stream entry of the reversing arm can be accomplished. While stream engagement does not present the same type of hydraulic force balancing that is presented in the case of stream disengagement, nevertheless, for any given sprinkler head there is always a minimum energy level below which stream entry will not take place. A sprinkler head which provides effective operation over a wide range of energy levels, including low energy levels, would therefore provide significant improvement over prior art devices.

Stalling of the sprinkler head at reversing arm stream penetration can generally be traced to two factors. One of these factors is the spring force acting on the reversing arm throughout its range of movement between its operative and inoperative positions. In actual commercial operation, the weight biasing arrangement disclosed in U.S. Pat. No. 2,649,268 was apparently found to be insufficient to stably maintain the reversing arm in its inoperative position. When the disclosure of this patent was marketed under the name "Volume Gun", an over-center spring bias was provided which served to bias the reversing arm both into its inoperative position and into its operative position with a null point at an intermediate position. Of course, a problem with an arrangement of this type is that the spring biasing of the reversing arm into its operative position simply adds to the minimum force requirement necessary to effect stream disengagement of the reversing arm and presents a situation where start-up could occur in the reversing mode of operation with the resultant possibility of an incomplete reversing stroke causing the sprinkler head to stall during the stream disengagement event.

The spring arrangement provided in my prior U.S. Pat. No. 3,559,887, while obviating malfunctioning problems as a result of start-up in reverse, provided a spring arrangement which was able to yield in response to reversing arm movement in a direction opposed to the direction of spring bias so that the spring force applied increased as the reversing arm moved away from its inoperative position. Thus, a minimum spring force is applied when the reversing arm is in its inoperative position. Normally, the strength of the spring is chosen to enable this minimum force to stably maintain the reversing arm in the inoperative position it assumes during the major part of each operative cycle where the impulses of the drive spoon take place. With this arrangement, the minimum spring force provided became greater when the reversing arm reached a position away from its inoperative position where the reactant element commenced to enter the stream. Consequently, this increased spring force increased the minimum energy level of the stream required to effect stream entry.

Accordingly, it is a further object of the present invention to provide a sprinkler head of the type described having an improved quick return reversing mechanism which has improved capabilities of operating at low energy levels by providing for an improved application of spring forces to the reversing arm thereof. In accordance with the principles of the present invention, this objective is obtained by applying the spring force which serves to stably maintain the reversing arm in its inoperative position to the reversing arm such that the biasing force decreases, rather than increases as the reversing arm moves away from the inoperative position and toward its operative position. Thus, with the present invention, the spring force required to stably maintain the reversing arm in its inoperative position constitutes the maximum spring force applied to the arm rather than the minimum as in the prior art.

Preferably, this decreasing spring force action is obtained by decreasing the lever arm through which the spring acts on the reversing arm as the latter moves away from its inoperative position and toward its operative position.

It will be understood that by following the teachings of the present invention with respect to the spring force application to the reversing arm, the minimum level at which stream entry can be accomplished is reduced. The extent to which such reduction can be accomplished will depend somewhat on the system utilized to effect stream disengagement. For example, where the principles of the present invention enunciated above with respect to stream disengagement are followed, the problem of starting up in the reverse mode of operation previously noted is likewise materially reduced if not completely eliminated. Under these circumstances, reduction in the application of the spring forces in accordance with the principles of the present invention may be reduced substantially to zero when the reversing arm is in its operative position and the reversing arm can simply be left in its operative position at the time of shut-off since any appreciable incomplete return stroke is sufficient to effect stream disengagement.

On the other hand, where the disengagement event utilized makes it important to embody into the reversing mechanism spring bias of the reversing arm out of its operative position in response to stream shut-off, the decrease in the application of the spring force cannot be reduced to zero but only to that value less than the value applied at the inoperative position sufficient to effect spring biased movement of the reversing arm out of its operative position and into such inoperative position.

The second factor which adversely affects reversing arm stream penetration is the configuration of the reactant surface of the reactant element which initially engages the stream. Heretofore, this structure has consisted of a sharp leading edge. A characteristic mode of operation relating to such sharp leading edges is that during initial penetration, an incremental layer of the stream is sheared off by the edge. Initially, the sheared-off layer is of thinnest configuration and is deflected almost at right angles. As the sheared layer increases in thickness, the angle of deflection reduces until finally the sheared-off layer impinges upon the reactant surface extending from the sharp leading edge. Actually, it is not until this latter event occurs that a reactant force is imposed upon a reactant element which acts in a direction to move the reactant element into the stream. Moreover, during the shearing action above mentioned, the stream engaging the sharp edge has a slight reactant surface area which is acting in a direction to oppose penetration. While this reactant force may be regarded as initially negligible, it does increase as wear occurs. Wear can be considerable where high volume and relatively grit-contaminated, non-municipal water supplies are utilized as in agricultural irrigation. Such wear changes the sharp edge configuration into a dull edge configuration so that the effect of the anti-penetration reactant force increases. Consequently, the effect mentioned above results in an increasing of the minimum energy levels at which penetration will take place as a given sprinkler head ages and wear takes place.

Accordingly, it is a further object of the present invention to provide a sprinkler head of the type described having an improved quick return reversing mechanism which obviates the disadvantages resulting from wear indicated above. In accordance with the principles of the present invention, this objective is obtained by eliminating the sharp leading edge as the initial penetrating structure of the reactant element, providing instead coanda-effect surface means on the reactant element of the reversing arm operable during an intermediate penetrating incremental range of movement of the reversing arm (after its initial incremental range of movement from its inoperative position where the reactant surfaces are out of engagement with the stream and before its final incremental range of movement when the reactant surfaces thereof are in engagement with the stream) to establish coanda-effect force acting on the reversing arm in a direction to bias the reactant element into the stream toward its operative position.

Preferably, the coanda-effect surface means consists of a shallowly curved surface disposed almost in alignment with the direction of stream movement so there is very little tendency for wear to significantly alter its configuration as is the case with a sharp edge. Preferably, the reactant surface required to bias the reversing arm into the stream can be provided by the upper surface of a thin plate, the lower surface of which provides the coanda-effect surface. In this way, the transition of the reactant surfaces into the stream is accomplished by the provision of a thin plate, the effects of wear on the leading edge of which is negligible.

These and other objects of the present invention will become more apparent during the course of the following detailed description of the invention and the appended claims.

The invention may best be understood with reference to the accompanying drawings wherein an illustrative embodiment is shown.

In the drawings:

FIG. 6 is an enlarged fragmentary sectional view taken along line 6—6 of FIG. 1 showing the reactant element of the reversing arm in an intermediate position of movement and the coanda-effect relationship of the stream thereto;

FIG. 7 is an end elevation of the reactant element shown in FIG. 6;

FIG. 9 is an enlarged fragmentary sectional view taken along line 9—9 of FIG. 5; and FIG. 10 is an enlarged fragmentary sectional view taken along line 10—10 of FIG. 1.

Figure 1:
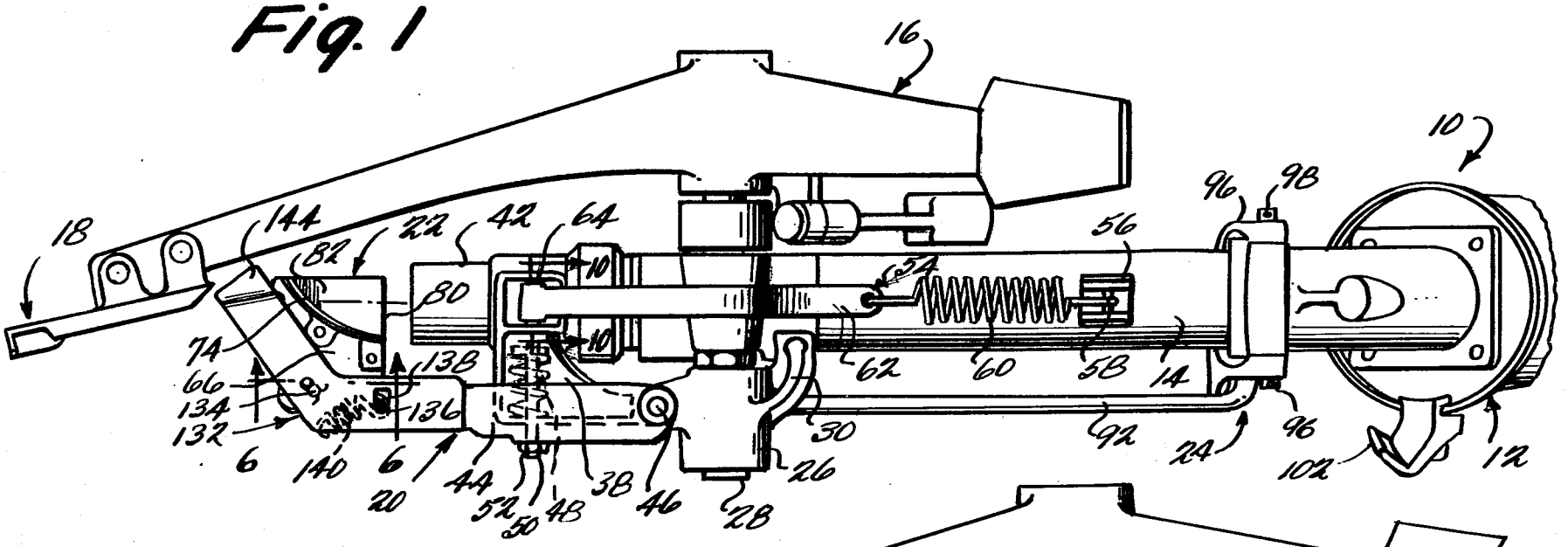
FIG. 1 is a plan view of a sprinkler head embodying the principles of the present invention taken from a view perpendicular to the axis of the outlet of the sprinkler body and showing the reversing arm of the reversing mechanism in its inoperative position.

Referring now more particularly to the drawings, there is shown in FIG. 1 thereof a sprinkler head, generally indicated at 10, embodying the principles of the present invention. It will be understood that the sprinkler head 10 is adapted to be mounted on the upper end of a riser pipe, the lower end of which is communicated through suitable conduit to a source of water under pressure. Where the head 10 is used to sprinkler irrigate, the riser may be stationarily mounted in the field or may be carried by a traveling vehicle. For example, the sprinkler head 10 of the present invention would find particular utility in a traveling sprinkler irrigation device of the type disclosed in commonly assigned U.S. Pat. No. 3,507,336 dated Apr. 21, 1970.

The sprinkler head 10 of the present invention includes, in general, a swivel and spring brake assembly, generally indicated at 12, which is adapted to be connected at its lower end with the riser. A sprinkler body, generally indiated at 14, is connected with the upper end of the swivel and spring brake assembly in hydraulic communication with the riser pipe for directing the flow of water upwardly and outwardly, the swivel and spring brake assembly 12 mounting the sprinkler body for controlled rotational movement about a generally vertical axis. The sprinkler body 14 directs the water under pressure communicated therewith in a stream flowing therefrom in generally symmetrical relation to a plane passing through the axis of rotation.

An impulse arm assembly, generally indicated at 16, is pivotally mounted on the sprinkler body for oscillatory movement about an axis extending transverse to the aforesaid plane. The impulse arm assembly 16 includes a reactant means, generally indicated at 18, on the outer end thereof and is normally biased into a limited position wherein the reactant means 18 is disposed within the path of a stream issuing from the sprinkler body. The reactant means 18 is operable in response to the energy of a stream issuing from the sprinkler body to effect movement of the arm through repeated oscillatory cycles, each of which includes an impulse stroke wherein the reactant means leaves the stream and moves away from the latter in one direction and a return stroke wherein the reactant means moves in the opposite direction toward the stream and enters the latter. The reactant means 18 is also operable during the portion of each oscillatory cycle when it is disposed within the stream to impart an incremental rotational movement to the sprinkler head which is controlled by the swivel and spring brake assembly 12.

The sprinkler head 10 also includes a reversing arm assembly, generally indicated at 20, which is pivotally mounted on the sprinkler body for oscillatory movement about an axis extending transverse to the aforesaid plane and which, preferably, is concentric with the pivotal axis of the impulse arm assembly 16. The reversing arm assembly 20 includes a reversing reactant means 22 on the outer end thereof and is normally biased into a limited position wherein the reactant means 22 is disposed out of the path of a stream issuing from the sprinkler body. The reversing arm assembly 20 is adapted to be used when it is desired to sprinkler irrigate an area less than a full circle, as for example, a segmental portion of a circle proceeding from one end thereof to the opposite end thereof. The reversing arm assembly 20 is operable to rotate the sprinkler head from the opposite end back to the one end and in order to accomplish this operation, there is provided a reversing arm actuating mechanism, generally indicated at 24, which is operable in response to the sprinkler body reaching the opposite end of its rotation to effect a pivotal movement of the reversing arm assembly from its normally biased position into a position wherein the reversing reactant means 22 is engaged by the stream issuing from the sprinkler body and maintained therein by the stream against its normal bias. The reversing arm actuating mechanism 24 is operable, in response to the reversing rotational movement of the sprinkler body back to its one end, to effect a pivotal movement of the reversing arm assembly 20 back into its normally biased position wherein the reactant element 22 is disposed out of the path of the stream.

The swivel and spring brake assembly 12 may assume any known construction and the details thereof form no part of the present invention. An exemplary embodiment is shown in the aforesaid U.S. Pat. Nos. 3,559,887 and 3,623,666. A further example is illustrated in U.S. Pat. No. 3,744,720. Accordingly, the disclosure of each of these patents is incorporated by reference into the specification.

In a similar manner, the impulse arm assembly 16 and reactant means 18 may be of any known construction, the details of which form no part of the present invention. Here again, a preferred embodiment is disclosed in the aforesaid U.S. Pat. No. 3,559,887, whereas U.S. Pat. No. 3,623,666 suggests a further alternative embodiment which may be utilized. The present invention is more particularly concerned with the construction of the reversing arm mechanism and more specifically to improvements in a reversing arm mechanism of the general quick return type disclosed in U.S. Pat. No. 3,559,887 and specifically the specific pressure compensating quick return type disclosed in U.S. Pat. No. 3,623,666.

As best shown in FIGS. 1-5, the reversing arm assembly 20 includes a hub portion 26 which is journaled on a transversely extending shaft 28 provided for the purpose of pivotally supporting the impulse arm assembly 16. Extending rearwardly from the hub portion 26 is a rearward arm portion 30 having a stop button 32 formed on the free end thereof, which stop button is adapted to engage a stop button 34 carried by the sprinkler body 14, as by a bracket 36. The stop buttons 32 and 34 are adapted to engage one another when the reversing arm assembly 20 is disposed in its inoperative position.

The reversing arm assembly 20 also includes a forwardly extending arm portion 38. The arm portion 38 includes a laterally extending free end having a stop button 40 mounted on the lower surface thereof in a position to engage the upper surface of a discharge nozzle 42 mounted on the outer end of the sprinkler body 14. The button 40 is adapted to engage the upper surface of the nozzle 42 when the reversing arm assembly 20 is disposed in its operative position.

The reversing arm assembly 20 also includes a separate pressure compensating arm section 44, the inner end of which has a generally vertically extending pivotal connection 46 with the forwardly extending arm portion 30 at a position with the hub portion 26. The arm section 44 is of generally channel shaped configuration with the leg portions thereof extending generally horizontally above and below the arm portion 38 and bight portion thereof disposed laterally outwardly from the arm portion 38. The arm portion 38 includes a depending flange which is disposed generally parallel with the bight portion of the arm section 44 when the latter is in an inoperative limiting position which it assumes when the reversing arm assembly 20 is in its inoperative position. The arm section 44 is biased into this limiting position by suitable spring means which includes a coil spring 48, one end of which engages the laterally inner surface of the depending flange of the arm portion 38 and the other end of which engages the head of a bolt 50. The shank of the bolt 50 extends through appropriate apertures formed in the depending flange of the arm portion 38 and bight portion of the arm section 44 and has a nut 52 threadedly engaged on the outer end thereof. In this way, the spring 48 serves to resiliently bias the arm section 44 into its inoperative limiting position but to permit biased yielding movement of the arm section 44 away from such limiting position.

In accordance with the principles of the present invention, the reversing arm assembly 20 is spring biased toward its inoperative position by a spring mechanism, generally indicated at 54. The spring mechanism 54 serves to apply a predetermined spring force on the reversing arm assembly when the latter is in its inoperative position with the stop buttons 32 and 34 in engagement, which spring force acts on the reversing arm assembly 20 in a direction to stably maintain the same in the aforesaid inoperative position. The spring mechanism 54 also serves to apply a spring force on the reversing arm assembly 20 which acts in a direction to move the same toward its inoperative position which force decreases in response to the movement of the reversing arm assembly away from its inoperative position toward its operative position. As shown, the spring mechanism 54 includes a bracket 56 fixedly secured to the upper surface of the sprinkler body 14, the bracket carrying a cross pin 58 to which one end of a tension coil spring 60 is mounted. The opposite end of the coil spring 60 is connected to one end of a bent lever 62, the opposite end of which is pivoted, as by a transverse pin 64, to upstanding flanges formed on the lateral extension of the arm portion 38.

Figure 2:
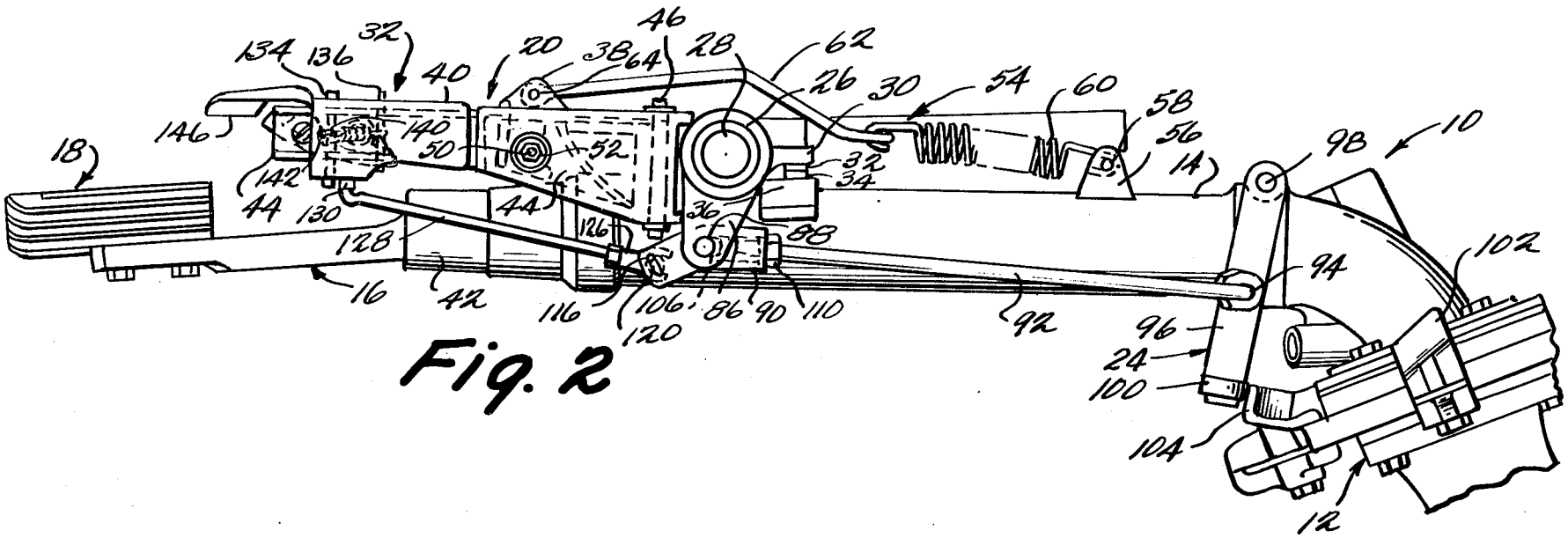
FIG. 2 is a side elevational view of the structure shown in FIG. 1.
Figure 4:
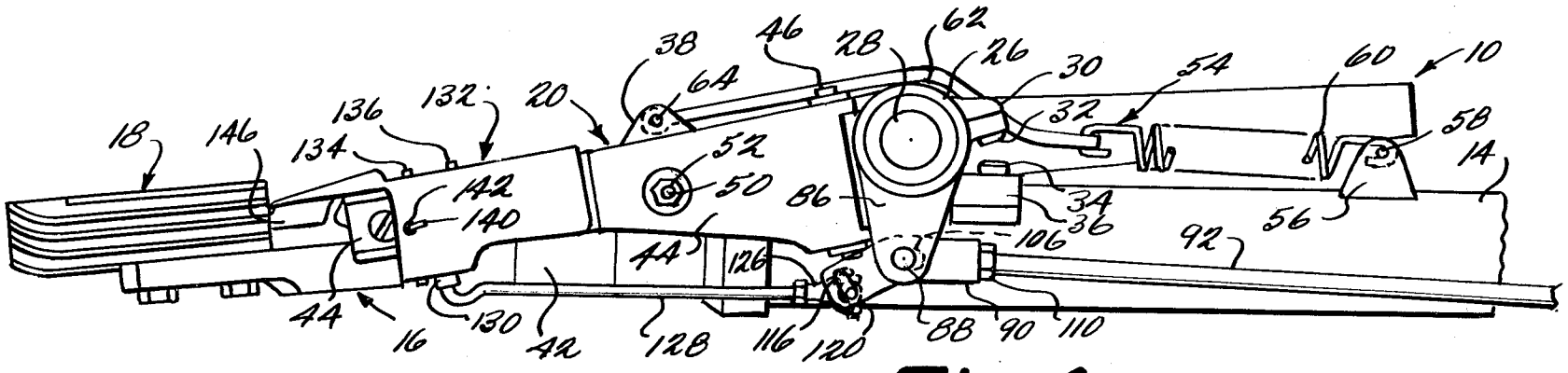
FIG. 4 is an enlarged fragmentary view similar to FIG. 2 showing the reversing arm in its operative position.
Figures 5, 8:
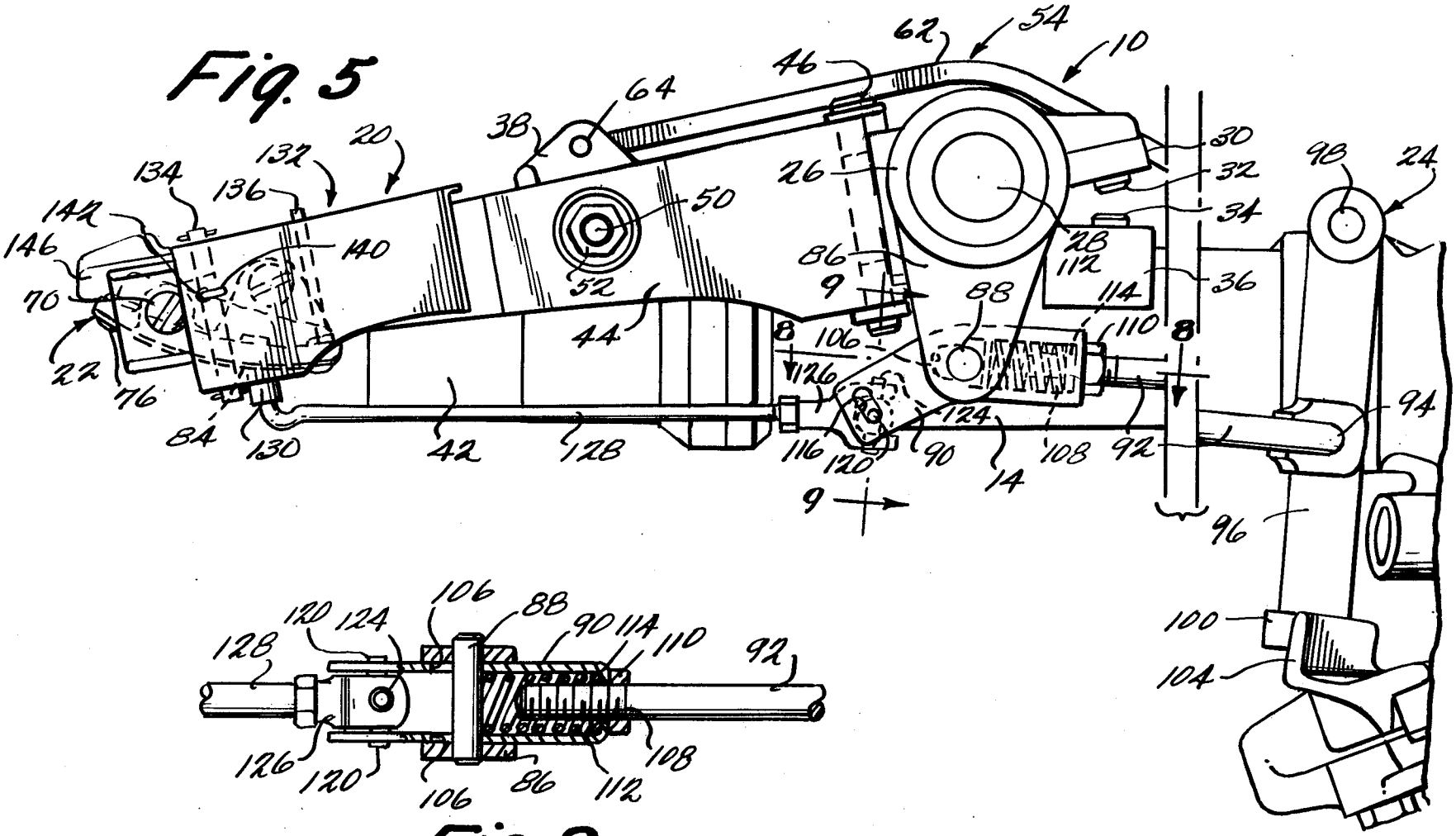
FIG. 5 is an enlarged fragmentary elevational view similar to FIG. 2 with parts broken away for purposes of clearer illustration and showing the position of the reversing mechanism parts after the secondary reactant element has been moved into its operative position in solid lines, the inoperative position in phantom lines and the operative position in dotted lines.
FIG. 8 is an enlarged fragmentary sectional view taken along line 8—8 of FIG. 5.

With reference to FIGS. 2 and 4, it will be noted that while spring 60 extends during the movement of the reversing arm assembly 20 from its inoperative position as shown in FIG. 2 to its operative position as shown in FIG. 4, the added spring force resulting from such extension when applied to the reversing arm assembly as torque in terms of foot pounds actually diminishes by virtue of the diminishing lever arm through which the spring force acts. In this regard, it will be noted that a plane which contains the axes of both pivot pins 58 and 64 of the spring assembly 54 is spaced above the axis of the shaft 48 a considerably greater distance when the reversing arm assembly 20 is disposed in its inoperative position, as shown in FIG. 2, than when in its operative position, as shown in FIG. 5. As shown, this lever arm distance through which the spring force acts may be substantially zero in the operative position of FIG. 4.

As will become more apparent hereinafter, it is not essential, in accordance with the teachings of the present invention, that the reversing arm assembly 20 be biased to move from its operative position into its inoperative position by the spring assembly 54 when the stream is shut off. Nevertheless, the present invention contemplates such a situation and where this function is desired, the lever arm through which the spring mechanism 54 acts when the reversing arm assembly is in its operative position is chosen to be just sufficient to effect such return action. The primary function of the spring mechanism 54 is to provide the stable maintenance of the reversing arm assembly 20 in its inoperative position, since it is in this position that the reversing arm assembly must remain during the majority of each operating cycle, such as when the sprinkler head is being moved in step-by-step rotary fashion under the action of the impulse arm assembly 16.

Referring now more particularly to FIGS. 6 and 7, in accordance with the principles of the present invention the reversing reactant means 22 is mounted on the outer end of the arm section 44 in a position so as to be disposed out of the path of the stream issuing from the nozzle 42 when the reversing arm assembly 20 is disposed in its inoperative position and into the path of the stream issuing from the nozzle 42 when the reversing arm assembly 20 is in its operative position. As shown, the reversing reactant means includes a reactant element 66 having an attaching flange 68 along one lateral extremity thereof which is adapted to be fixedly engaged with the inner surface of the free end of the arm section 44 as by bolts 70. The reactant element 66 is formed with a curved undersurface 72 and has an arcuate flange extending from the extremity thereof opposite from the attaching flange 68. The arcuate flange provides an arcuate reactant surface 74 which, when engaged by the stream, establishes a reversing reactant force component which acts in a direction to pivot the arm section 44 about the pivot 46 against the action of spring 48.

The magnitude of the reactant force component referred to above will depend upon the energy level of the stream 42 which engages the same and upon the angular position into which the arm section 44 is allowed to move by the yielding of the spring 48. The curvature of the reactant surface 74 and the strength of spring 48 are chosen in relation to the geometry of the arm section 44 such that the angle assumed by the surface 74 in relation to the axis of the nozzle 42 will decrease in response to an increase in the energy level of the stream at a rate such that the decrease in the reactant force component by virtue of the decrease in the angle of reactant surface 74 is generally equal to the increase in the force component by virtue of the increase in the energy level of the stream. Consequently, the reactant force component which acts on the arm section 44 in a direction tending to pivot the arm against the action of the spring is maintained at a relatively constant level irrespective of changes in the energy level of the stream issuing from the nozzle 42. It will be noted that this force component which is generally constant when the reversing arm is in its operative reversing position is transmitted by the spring 48, the reversing arm portion 38, the upper portion 26 and the shaft 28 to the sprinkler body 14 and constitutes the force component acting tangentially to the vertical axes of rotation of the sprinkler head which effects the quick return movement thereof. By providing means by which the reversing reactant force component is maintained at a constant level irrespective of the energy level of the stream, the return movement of the sprinkler head can be more accurately controlled so that its speed does not increase to a level where damaging inertia forces are set into motion. Moreover, the return force and speed can be maintained at a desirable minimum level which, in turn, means a constant cycle speed.

Referring again to FIGS. 6 and 7, the reactant means 22 also includes a lower thin curved reactant plate 76 which is fixedly secured to the curved under-surface 72 of the reactant element 66 as by rivets 78 or the like. The thin plate extends laterally outwardly from the reactant surface 74 and includes a leading edge 80 which is disposed in a position to be engaged by the stream when the reversing arm assembly 20 is in its operative stream engaging position. Extending from the leading edge 80 in the direction of stream movement coextensive with the reactant surface 74 is an upper reactant surface 82 and a lower coanda-effect surface 84.

With reference to FIG. 6, it will be noted that the curvature of the coanda-effect surface 84 is so related to the leading edge 80 of the reactant plate 76 that the coanda-effect surface 84 will initially engage the upper strata of the stream issuing from the nozzle 42 at a position spaced from the leading edge 80 during the movement of the reversing arm assembly 20 from its inoperative position into its operative position. As the coanda-effect surface 84 approaches the upper strata of the stream a coanda-effect fluidic force is created which acts on the reactant elements 66 and 76 in a direction to move the same inwardly into the stream toward the operative position of pivotal movement of the reversing arm assembly 20 about the shaft 28. The coanda-effect force tends to effect movement of the leading edge 80 of the plate 76 into the stream until the portion of the stream above the edge is directed onto the upper reactant surface 82. As the upper sliced-off portion of the stream engages the reactant surface 82, a reactant force component is established on the reactant plate 76 which acts in a direction tangential to the pivotal axis of the reversing arm assembly 20 to effect movement of the latter all the way into its operative position. This latter reactant force component increases as the reactant plate 76 enters the stream and ultimately becomes the dominant reactive force component acting in a direction tangential to the axis of the pivot 28. Consequently, this force component insures that the reactant means 22 will be maintained in its operative position so as to effect the operative return stroke of the sprinkler head.

The actuating mechanism 24 of the present invention is basically of the over-riding cam actuated type disclosed in the aforesaid U.S. Pat. No. 3,559,887.

The reversing arm actuating mechanism 24 preferably includes a depending lever arm portion 86 on the reversing arm assembly 20, the upper end of which is integrally formed with hub portion 26 and the lower end of which is apertured to receive a pivot pin 88. The pivot pin also extends through a clevis 90 which is connected to one end of an elongated connecting rod 92. The rearward end of the connecting rod 92 is bent transversely and pivotally engaged, as indicated at 94, within an apertured boss formed on one leg of a generally U-shaped yokelike lever 96. As best shown in FIGS. 2 and 5, the legs of the lever 96 embrace the sprinkler body 14, the upper extremities thereof being apertured to receive a pivot pin 98 which also extends through an apertured boss rigidly formed on the sprinkler body. The lower extremity of the lever 96 is provided with a cam roller 100 which is adapted to cooperate with a pair of cam members, generally indicated at 102 and 104.

The cam members 102 and 104 are mounted on the stationary part of the sprinkler head 10 in circumferentially spaced adjusted positions, in accordance with the teachings contained in the aforesaid U.S. Pat. No. 3,559,887. The cam members 102 and 104 are adapted to be engaged by the cam roller 100, the cam member 102 being operable when the reversing arm assembly 20 is in its inoperative position to effect movement thereof out of its inoperative position toward its operative position by effecting movement of the cam roller in a direction generally radially inwardly of the vertical axis of rotation of the sprinkler body 14. Since the cam member 102 serves to engage the reactant means 22 into the stream, the cam member 102 is referred to as an engagement cam. The cam member 104 constitutes a disengagement cam and when engaged by the cam roller 100 will effect a generally radially outward movement thereof with respect to the vertical axis of rotation of the sprinkler body 14.

In accordance with the principles of the present invention the initial radial outward movement of the cam roller 100 by the cam member 104 results in a movement of the clevis 90 with respect to the pivot pin 88. As best shown in FIG. 8, the clevis 90 is in the form of a U-shaped element, the central portion of the legs of which has elongated slots 106 therein through which the ends of the pivot pin 88 extend. The forward end portion of the connecting rod 92 extends through an aperture 108 in the bight portion of the U-shaped clevis 90. The end portion of the connecting rod 92 which extends through the aperture 108 in the bight portion of the clevis 90 is threaded and a nut 110 is threadedly engaged thereon in a position to engage the exterior of the bight portion. Mounted in surrounding relation to the threaded end portion of the connecting rod 92 between the adjacent legs of the U-shaped clevis 90 is a coil spring 112. One end of the coil spring 112 engages the pivot pin 88 and the other end engages a washer 114 seated on the inner surface of the bight portion of the U-shaped clevis 90. The spring 110 thus serves to resiliantly bias the U-shaped clevis 90 against the nut 110 carried by the connecting rod which, in turn, tends to move the clevis to the right as viewed in FIG. 4 so that the pivot pin 88 normally rests within the left-hand end of the slots 106. The free ends of the leg portions of the clevis 90 are formed with oblique or angularly extending slots 116. As best shown in FIG. 9, a pivot member 118 having reduced end portions 120 pivotally mounted within the slots 116 is formed with a central transverse opening 122 extending therethrough within which a cross pivot pin 124 is mounted. The ends of the cross pivot pin 124 are pivotally connected to a bifurcated clevis 126 connected with the rearward end of a secondary connecting rod 128. The forward end of the secondary connecting rod 128 is bent upwardly and pivotally interconnected, as indicated at 130, with a secondary reactant element, generally indicated at 132.

The secondary reactant element 132 is moved from an inoperative position out of the path of movement of the stream issuing from the nozzle 42 into a position of engagement by the stream when the aforesaid movement of the clevis 90 with respect to the pivot pin 88 takes place. This movement of the secondary reactant element 132 is accomplished through the dual pivotal connection of clevis 126 with the clevis 90 and the secondary connecting rod 128 and its connection 130 with the reactant element 132. The reactant element 132 is of generally angular shape in plan and its central portion has a generally U-shaped cross-sectional configuration. The legs of the U embrace the outer end portion of the reverse arm section 44 and are apertured to receive a pivot pin 134, the axis of which is parallel with the axis of the pivot pin 46 for the arm section 44.

A stop pin 136 is fixed to the arm section 44 and extends upwardly therefrom through a slot 138 formed in the upper leg of the reactant element 132 so as to determine the limits of its movement between its operative and inoperative positions. The secondary reactant element 132 is resiliently urged into its inoperative limiting position by a coil spring 140 having one end thereof connected to the stop pin 136 and the other end thereof engaged within an opening 142 in the bight portion of the reactant element 132. The reactant element 132 also includes a downwardly bent outer end portion 144 having a lower reactant surface 146. It will be noted that when the primary reversing reactant means 22 is disposed in its operative position, a portion of the stream issuing from the nozzle 42 will engage reactant surfaces 74 and 82 which has the effect of diverting this portion of the stream in a direction upwardly and to one side relative to the axis of the nozzle. When the secondary reactant element 132 is disposed in its inoperative position, the reactant surface 146 thereof is disposed out of the path of the stream. However, when the reactant element 132 is moved from its inoperative position into its operative position, the reactant surface 146 is moved into a position to be engaged by the water directed upwardly and outwardly by the reactant surfaces 82 and 74.

Figure 3:
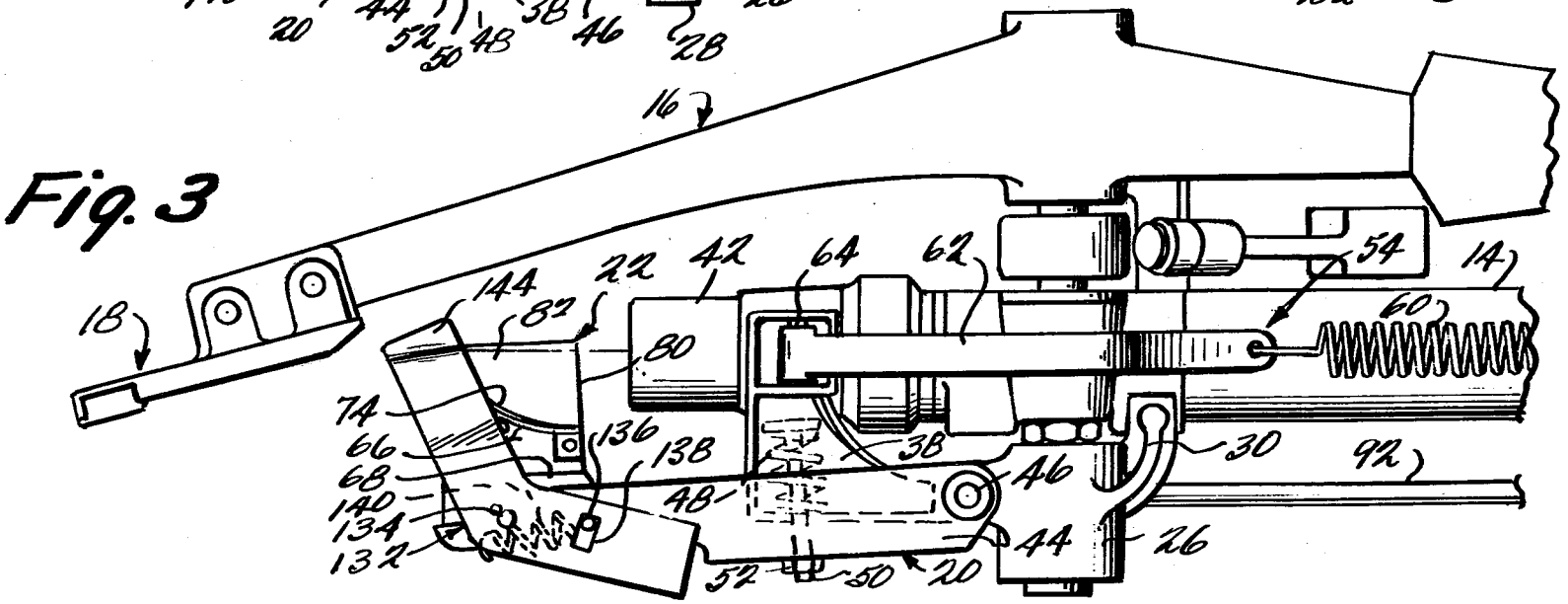
FIG. 3 is an enlarged fragmentary view similar to FIG. 1 showing the reversing arm and secondary reactant element in their operative positions.

The angular disposition of the reactant surface 146 with respect to the water engaged thereby establishes one force component thereon which acts tangentially to the axis of rotation of the reactant element 132 about the pivot pin 134 in a direction to move the reactant element 132 clockwise as viewed in FIG. 3 against the action of the spring 140. This reactant force component tends to assist and maintain the reactant element 132 in its operative position. In addition to the reactant element moving resultant force component, the engagement of the portion of the stream with the reactant surface 146 of the secondary reactant element 132 also establishes a resultant force component on the secondary reactant element 132 which acts tangentially to the pivotal axis provided by the shaft 28 of the reversing arm assembly 20 in a direction to move the reversing arm assembly clockwise, as viewed in FIG. 5. This reactant component force is transmitted to the arm portion 38 of the reversing arm assembly 20 through the pivot pin 136, the arm section 44 and the pivot pin 46 thereof.

As previously indicated, it is preferable that the reversing arm moving resultant force component is of sufficient magnitude to overcome the opposite reversing arm moving resultant force component acting on the resultant means 22 so that as soon as the secondary reactant element 132 is moved from its inoperative position to its operative position, the force component which previously was acting on the reversing arm assembly tending to maintain its operative position is reduced preferably to the point of being reversed and hence the reversing arm assembly 20 is moved from its operative position to its inoperative position. It will be noted that after the above-mentioned initial movement takes place, cam roller 100 continues to ride up the cam member 104 which movement is transmitted through yoke 96 and connecting rod 92 to the reversing arm assembly 20 by virtue of the engagement of the end of the slots 106 of the clevis 90 with the pivot pin 88 carried by lever arm 86 of the reversing arm assembly.

OPERATION

For sake of convenience, the cycle of operation of the sprinkler head 10 will be described beginning with the reversing arm assembly 20 disposed in its inoperative position, as shown in FIGS. 1 and 2, and the sprinkler body 14 being advanced under the operation of the impulse arm assembly 16 in step-by-step fashion in a counterclockwise direction, as viewed in FIG. 1. When the sprinkler body 14 reaches a position of step-by-step rotational movement, such that cam follower 100 engages cam member 102, the further rotational movement will effect a generally radially inward movement of the cam roller 100 which, in turn, by virtue of yoke 96, connecting rod 92, clevis 90, pivot pin 88 and lever arm 86, will effect a movement of the reversing arm assembly 20 out of the inoperative position, as shown in FIG. 2, toward its operative position as shown in FIG. 4. It will be noted that the spring mechanism 54 which normally stably maintains the reversing arm assembly 20 in its inoperative position during the step-by-step movement of the sprinkler body under the action of the impulse arm assembly 16, will apply a decreasing torque to the reversing arm assembly 20 as the latter moves from its operative position. This decreasing torque effect is accomplished notwithstanding the extension of the spring 60 by virtue of the decreasing lever arm through which the spring mechanism 54 acts on the reversing arm assembly. In this way, the strength of spring 60 is chosen to be just sufficient to stably maintain the reversing arm assembly in its inoperative position and hence this spring force determines the maximum torque which must be overcome during the inward movement of the cam follower roller 100 by the cam member 102.

As the reactant means 22 carried by the reversing arm assembly approaches the upper strata of the stream issuing from the nozzle 42, the lower coanda-effect surface 84 of the reactant plate 76 will be engaged by the upper strata of the stream at a position spaced from the leading edge 80 of the reactant plate 76 when the latter is spaced from the upper strata of the stream a distance as indicated by the dot-dash line in FIG. 6. The proximity of the coanda-effect surface 84 with the upper strata of the stream establishes a coanda-effect force which acts on the reactant means 22 in a direction to move the latter into the stream. Consequently, when the edge 80 engages the stream and initially effects a shearing off of the upper strata of the stream in a manner which would normally establish a resistance to the reactant means entering the stream, there has already been provided a hydraulically induced force tending to move the leading edge 80 sufficiently into the stream so that the water strata above the edge will flow onto the reactant surface 82 and impose a reactant force on the reactant means 22 which will increase until the reversing arm assembly 20 reaches its operative limiting position.

With the reactant means 22 in its operative position, a portion of the stream is engaged by both the reactant surface 82 and the reactant surface 74. The latter establishes a reactant force component which tends to pivot the arm section 44 about its pivot 46 in a direction against the action of spring 48. As previously indicated, the force of spring 48 is chosen such that the angle which the reactant surface 74 assumes with respect to the axis of the nozzle 42 is so proportioned with respect to the inertia level of the stream as to cause the spring 48 to transmit to the arm portion 38 a relatively constant reactant force component so that the sprinkler body 14 will be moved in a reversing direction about its vertical axis of movement at a generally constant rate, irrespective of changes in the pressure of the water source. This movement will continue until cam follower roller 100 moves into engagement with the cam member 104. As previously indicated, the initial generally radially outward movement of the cam roller 100 has the effect of moving the secondary reactant element 132 from its inoperative position as shown in FIG. 4 into its operative position as shown in FIGS. 3 and 5. This movement is accomplished by virtue of the pin and slot connection 88–106 and the connecting rods 92 and 128. The movement of the reactant surface 146 of the secondary reactant element into engagement with the stream has the effect of reversing the reactant force component acting on the reversing arm assembly tangentially to its pivotal axis provided by the shaft 28 so that, in conjunction with the continued movement of the cam roller 100 in engagement with the surface of the cam member 104, the reversing arm assembly 20 is moved from its operative position, as shown in FIGS. 3 and 5, into its inoperative position, as shown in FIGS. 1 and 2. It will be noted that during this movement, clevis 90 will shift rearwardly under the action of spring 112 so that pivot pin 88 is engaged within the left-hand end of the slot 106, as indicated in FIG. 2. In addition, spring 140 will serve to pivot the reversing reactant element 132 back into its inoperative position, such movement being accommodated by the engagement of pin ends 120 within slots 116. As can be seen from FIG. 2, the point of intersection between the axis of pin ends 120 and pin 124 is aligned with the axis of the shaft 46.

It can thus be seen that by following the principles of the present invention, the force requirements to accomplish the movement of the reversing arm assembly 20 from its inoperative position into its operative position and from its operative position into its inoperative position are materially reduced with respect to the force requirements heretofore. The biggest force requirement heretofore has been the inertia force required to achieve the disengagement function. As previously indicated, this requirement often resulted in the prior art sprinkler heads hanging up at the disengagement function position where start-up was not accomplished in a rapid fashion and the like. The inertia force necessary to accomplish disengagement is materially reduced in accordance with the principles of the present invention by eliminating the need to mechanically move the reversing arm assembly 20 against the hydraulic reactant force component acting on the reversing reactant element while in its operative position and instead requiring only a force sufficient to move a secondary reactant element from an inoperative position into an operative position. Once the secondary reactant element is engaged in the stream, the reactant force component which heretofore had to be mechanically overcome could then be either materially reduced by a hydraulically induced counterforce or, as preferred, completely reversed. By eliminating the need for a high inertia force to effect disengagement, the return force and hence return speed can be minimized which, in turn, tends to minimize damaging impact forces. Moreover, by providing pressure compensation an essentially constant minimum return force and speed is provided throughout a wide range of pressure or energy level in the water source.

Furthermore, by minimizing the inertia forces required to effect disengagement, it is no longer essential that the reversing arm assembly 20 be spring biased to move from its operative position in response to stream shut-off, since disengagement can be effected even where slow start-up occurs in the middle or near the end of the reversing portion of the cycle. The reduction of this spring force facilitates the engagement function. By applying the spring force to the reversing arm mechanism which stably maintains the latter in its inoperative position in accordance with the principles of the present invention, the force necessary to accomplish the engagement function is further reduced compared with the prior art arrangements in which the torque applied by the spring force was increased, rather than decreased, as the reversing arm assembly moved away from its inoperative position. Finally, the force required to accomplish the engagement function is further reduced by utilizing the coanda-effect principle enunciated herein. By utilizing the coanda-effect, the resistance to movement inherently provided by the necessity to move a sharp edge into the stream sufficient to enable the sliced-off portion of the stream to adhere to the reactant surface rearwardly of the sharp edge is eliminated. Here again, at high energy levels such force can be appreciable. Moreover, as the sharp edge wears, due to water contact, the resistance increases. With the coanda-effect surface principle of the present invention, no increased resistance due to wear will be observed.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A part-circle sprinkler head comprising a sprinkler body having an inlet and an outlet, means for mounting said sprinkler body for controlled rotational movement about a generally vertical axis with said inlet in communication with a conduit arranged to communicate a source of water under pressure therewith, said outlet being disposed to direct water under pressure communicated with said outlet in a stream flowing therefrom in a direction upwardly and outwardly in generally symmetrical relation to a plane passing through the axis of rotation, an impulse arm pivotally mounted with respect to said sprinkler body for oscillatory movement and having a reactant element thereon, said impulse arm being normally biased into a limiting position wherein said reactant element is disposed within the path of a stream issuing from said outlet and having means thereon operable (1) in response to the energy of a stream issuing from said outlet to move through repeated oscillatory cycles each of which includes an impulse stroke wherein said reactant element leaves the stream and moves away from the latter in one direction and a return stroke wherein said reactant element moves in the opposite direction toward said stream and enters the latter, and (2) during each oscillatory cycle thereof to effect controlled incremental rotational movement of said sprinkler body in one direction, a reversing arm mounted with respect to said sprinkler body for movement between operative and inoperative positions, reversing reactant surface means on said reversing arm engageable by a stream issuing from said outlet when said reversing arm is disposed in said operative position for establishing (1) a resultant body reversing force component acting through said reversing arm on said sprinkler body in a direction tangential to the rotational axis of said sprinkler body for effecting a reversing rotational movement in the opposite direction and (2) a resultant reversing arm moving force component acting on said reversing arm in a direction to move the same toward and into said operative position, and means (1) operable in response to the movement of said sprinkler body through a first predetermined incremental range of movement in said one direction for enabling said reversing arm to move from said inoperative position into said operative position and (2) operable in response to the movement of said sprinkler body through a second predetermined incremental range of movement in said opposite direction for (A) materially reducing the aforesaid resultant arm moving force component acting on said reversing arm while the latter is in said operative position and (B) enabling said reversing arm to move from said operative position after said force component reduction and into said inoperative position.

2. A part-circle sprinkler head as defined in claim 1 wherein said reversing reactant surface means is provided on a reactant structure mounted on said reversing arm for resilient yielding movement into different operative positions corresponding to and determined by the energy level of the stream engaging said reversing reactant surface means, the particular operative position of said reactant structure causing the resultant body reversing force component established by engagement of the stream with said reversing reactant surface means to remain generally constant throughout a relatively wide range of energy levels in said stream.

3. A part-circle sprinkler head as defined in claim 2 wherein said reversing arm is pivotally mounted on said sprinkler body for pivotal movement about an axis perpendicular to the pivotal axis of said sprinkler body, said reactant structure including an arm section pivotally mounted on said reversing arm for pivotal movement about an axis perpendicular to the axis of pivotal movement of said reversing arm from a spring biased limiting position into different operative positions spaced therefrom and spring means between said reversing arm and said arm section resiliently urging the latter into said spring biased limiting position.

4. A part-circle sprinkler head as defined in claim 3 wherein the different operative positions of said arm section correspond to different angular positions of said reversing reactant surface means with respect to the axis of the stream outlet, the generally constant resultant body reversing force component being established by decreasing the aforesaid angle as the energy level of the stream is increased.

5. A part-circle sprinkler head as defined in claim 3 wherein said means for reducing said resultant arm moving force component comprises a secondary reactant element mounted for movement between an inoperative position disposed out of engagement by the stream issuing from said outlet and an operative position disposed in engagement with the stream issuing from said outlet when said reversing arm is in its operative position, said secondary reactant element having second reactant surface means thereon operable when engaged by the stream issuing from said outlet to establish a secondary resultant arm moving force component acting through said secondary reactant element on said reversing arm in a direction opposed to the direction of said first mentioned resultant arm moving force component to thereby reduce the latter.

6. A part-circle sprinkler head as defined in claim 5 wherein said means for reducing said resultant arm moving force component further comprises first and second cam means adjustably fixed in spaced relation on said sprinkler head and motion transmitting means (1) movable by said first cam means during the movement of said sprinkler body through said first predetermined incremental range of movement in said one direction for effecting movement of said reversing arm from said inoperative position into said operative position and (2) movable by said second cam means during the movement of said sprinkler body through said second predetermined incremental range of movement in said opposite direction for moving said secondary reactant element from said inoperative position into said operative position while said reversing arm is in said operative position.

7. A part-circle sprinkler head as defined in claim 6 wherein said motion transmitting means comprises a lever pivotally mounted on said sprinkler body for movement between first and second limiting positions, a cam engaging roller carried by said lever, a first connecting rod pivoted at one end to said lever, lost motion means connecting the other end of said first connecting rod to said reversing arm, and a second connecting rod connected between said lost motion means and said secondary reactant element.

8. A part-circle sprinkler head as defined in claim 7 wherein said lost motion means comprises a U-shaped clevis member having a bight portion and spaced leg portions, said bight portion being apertured to slidably receive therethrough the other end portion of said first connecting rod, the free ends of said leg portions being slotted to receive a universal pivot pin assembly connected to the adjacent end of said second connecting rod, said reversing arm having a transversely extending pivot pin thereon extending through slots formed in said leg portions between the free ends thereof and said bight portion and a coil spring between said transversely extending pivot pin and said bight portion in surrounding relation to the other end portion of said first connecting rod.

9. A part-circle sprinkler head as defined in claim 8 wherein the universal pivot pin assembly provides two pivotal axes which intersect at a point, said point being aligned with the axis of pivotal movement of said arm section when said reversing arm is in said inoperative position.

10. A part-circle sprinkler head as defined in claim 2 wherein said reactant structure includes coanda-effect surface means thereon (1) operable to be disposed out of engagement with a stream issuing from said outlet during an initial incremental range of movement of said reversing arm from said inoperative position, and (2) operable to be engaged by the stream issuing from said outlet during an intermediate incremental range of movement of said reversing arm to create a coanda-effect force acting on said reversing arm in a direction to move the same toward said operative position.

11. A part-circle sprinkler head as defined in claim 10, wherein said reactant structure includes a thin reactant plate having an edge which constitutes said leading edge, a convexly curved surface extending from said edge which constitutes said coanda-effect surface means and a concavely curved surface extending from said edge which constitutes a part of said reversing reactant surface means.

12. A part-circle sprinkler head as defined in claim 11, wherein said reactant structure further includes a flange portion having a surface constituting a part of said reversing reactant surface means which extends toward and intersects said concavely curved surface along a line extending from side to side thereon from a point adjacent said leading edge to a point remote from said leading edge.

13. A part-circle sprinkler head as defined in claim 12 wherein said convexly curved surface is related to said leading edge such that during the movement of said reversing arm from said inoperative position to said operative position said convexly curved surface will engage the stream before said leading edge.

14. A part-circle sprinkler head as defined in claim 10 wherein spring means is operatively connected with said reversing arm (1) for applying a predetermined spring force on said reversing arm when the latter is in said inoperative position which acts thereon in a direction to stably maintain said reversing arm in said inoperative position and (2) for applying a spring force on said reversing arm which acts in a direction to move said reversing arm toward said inoperative position which decreases in response to the movement of such reversing arm away from said inoperative position toward and into said operative position.

15. A part-circle sprinkler head as defined in claim 14 wherein said reversing arm is pivotally mounted on said sprinkler body for pivotal movement about an axis perpendicular to the pivotal axis of said sprinkler body, said spring means being connected between said sprinkler body and said reversing arm so that the stress force thereof is applied to said reversing arm in spaced relation to its axis when said reversing arm is in said inoperative position, the arrangement being such that the torque applied to said reversing arm as a result of said spring stress force and said spaced relation decreases as said reversing arm is moved from its inoperative position toward its operative position by virtue of the decrease in said spaced relation notwithstanding an increase in said spring stress force.

16. A part-circle sprinkler head as defined in claim 1 wherein said reactant structure includes coanda-effect surface means thereof (1) operable to be disposed out of engagement with a stream issuing from said outlet during an initial incremental range of movement of said reversing arm from said inoperative position, and (2) operable to be engaged by the stream issuing from said outlet during an intermediate incremental range of movement of said reversing arm to create a coanda-effect force acting on said reversing arm in a direction to move the same toward said operative position.

17. A part-circle sprinkler head as defined in claim 16 wherein said reactant structure includes a thin reactant plate having an edge which constitutes said leading edge, a convexly curved surface extending from said edge which constitutes said coanda-effect surface means and a concavely curved surface extending from said edge which constitutes a part of said reversing reactant surface means.

18. A part-circle sprinkler head as defined in claim 17 wherein said reactant structure further includes a flange portion having a surface constituting a part of said reversing reactant surface means which extends toward and intersects said concavely curved surface along a line extending from side to side thereon from a point adjacent said leading edge to a point remote from said leading edge.

19. A part-circle sprinkler head as defined in claim 18 wherein said convexly curved surface is related to said leading edge such that during the movement of said reversing arm from said inoperative position to said operative position said convexly curved surface will engage the stream before said leading edge.

20. A part-circle sprinkler head as defined in claim 16 wherein spring means is operatively connected with said reversing arm (1) for applying a predetermined spring force on said reversing arm when the latter is in said inoperative position which acts thereon in a direction to stably maintain said reversing arm in said inoperative position and (2) for applying a spring force on said reversing arm which acts in a direction to move said reversing arm toward said inoperative position which decreases in response to the movement of such reversing arm away from said inoperative position toward and into said operative position.

21. A part-circle sprinkler head as defined in claim 20 wherein said reversing arm is pivotally mounted on said sprinkler body for pivotal movement about an axis perpendicular to the pivotal axis of said sprinkler body, said spring means being connected between said sprinkler body and said reversing arm so that the stress force thereof is applied to said reversing arm in spaced relation to its axis when said reversing arm is in said inoperative position, the arrangement being such that the torque applied to said reversing arm as a result of said spring stress force and said space relation decreases as said reversing arm is moved from its inoperative position toward its operative position by virtue of the decrease in said spaced relation notwithstanding an increase in said spring stress force.

22. A part-circle sprinkler head as defined in claim 1 wherein spring means is operatively connected with said reversing arm (1) for applying a predetermined spring force on said reversing arm when the latter is in said inoperative position which acts thereon in a direction to stably maintain said reversing arm in said inoperative position and (2) for applying a spring force on said reversing arm which acts in a direction to move said reversing arm toward said inoperative position which decreases in response to the movement of such reversing arm away from said inoperative position toward and into said operative position.

23. A part-circle sprinkler head as defined in claim 22 wherein said reversing arm is pivotally mounted on said sprinkler body for pivotal movement about an axis perpendicular to the pivotal axis of said sprinkler body, said spring means being connected between said sprinkler body and said reversing arm so that the stress force thereof is applied to said reversing arm in spaced relation to its axis when said reversing arm is in said inoperative position, the arrangement being such that the torque applied to said reversing arm as a result of said spring stress force and said space relation decreases as said reversing arm is moved from its inoperative position toward its operative position by virtue of the decrease in said spaced relation notwithstanding an increase in said spring stress force.

24. A part-circle sprinkler head as defined in claim 22 wherein said reversing reactant surface means is provided on a reactant structure mounted on said reversing arm for resilient yielding movement into different operative positions corresponding to and determined by the energy level of the stream engaging said reversing reactant surface means, the particular operative position of said reactant structure causing the resultant body reversing force component established by engagement of the stream with said reversing reactant surface means to remain generally constant throughout a relatively wide range of energy levels in said stream.

25. A part-circle sprinkler head as defined in claim 24 wherein said reversing arm is pivotally mounted on said sprinkler body for pivotal movement about an axis perpendicular to the pivotal axis of said sprinkler body, said reactant structure including an arm section pivotally mounted on said reversing arm for pivotal movement about an axis perpendicular to the axis of pivotal movement of said reversing arm from a spring biased limiting position into different operative positions spaced therefrom and spring means between said reversing arm and said arm section resiliently urging the latter into said spring biased limiting position.

26. A part-circle sprinkler head as defined in claim 1 wherein said means for reducing said resultant arm moving force component comprises a secondary reactant element mounted for movement between an inoperative position disposed out of engagement by the stream issuing from said outlet and an operative position disposed in engagement with the stream issuing from said outlet when said reversing arm is in its operative position, said secondary reactant element having secondary reactant surface means thereon operable when engaged by the stream issuing from said outlet to establish a secondary resultant arm moving force component acting through said secondary reactant element on said reversing arm in a direction opposed to the direction of said first mentioned resultant arm moving force component to thereby reduce the latter.

27. A part-circle sprinkler head as defined in claim 26 wherein said means for reducing said resultant arm moving force component further comprises first and second cam means adjustably fixed in spaced relation on said sprinkler head and motion transmitting means (1) movable by said first cam means during the movement of said sprinkler body through said first predetermined incremental range of movement in said one direction for effecting movement of said reversing arm from said inoperative position into said operative position and (2) movable by said second cam means during the movement of said sprinkler body through said second predetermined incremental range of movement in said opposite direction for moving said secondary reactant element from said inoperative position into said operative position while said reversing arm is in said operative position.

28. A part-circle sprinkler head as defined in claim 27 wherein said motion transmitting means comprises a lever pivotally mounted on said sprinkler body for movement between first and second limiting positions, a cam engaging roller carried by said lever, a first connecting rod pivoted at one end to said lever, lost motion means connecting the other end of said first connecting rod to said reversing arm, and a second connecting rod connected between said lost motion means and said secondary reactant element.

29. A part-circle sprinkler head as defined in claim 28 wherein said lost motion means comprises a U-shaped clevis member having a bight portion and spaced leg portions, said bight portion being apertured to slidably receive therethrough the other end portion of said first connecting rod, the free ends of said leg portions being slotted to receive a universal pivot pin assembly connected to the adjacent end of said second connecting rod, said reversing arm having a transversely extending pivot pin thereon extending through slots formed in said leg portions between the free ends thereof and said bight portion and a coil spring between said transversely extending pivot pin and said bight portion in surrounding relation to the other end portion of said first connecting rod.

30. A part circle sprinkler head comprising a sprinkler body having an inlet and an outlet, means for mounting said sprinkler body for controlled rotational movement about a generally vertical axis with said inlet in communication with a conduit arranged to communicate a source of water under pressure therewith, said outlet being disposed to direct water under pressure communicated with said inlet in a stream flowing therefrom in a direction upwardly and outwardly in generally symmetrical relation to a plane passing through the axis of rotation, an impulse arm pivotally mounted with respect to said sprinkler body for oscillatory movement and having a reactant element thereon, said impluse arm being normally biased into a limiting position wherein said reactant element is disposed within the path of a stream issuing from said outlet and having means thereon operable (1) in response to the energy of a stream issuing from said outlet to move through repeated oscillatory cycles each of which includes an impulse stroke wherein said reactant element leaves the stream and moves away from the latter in one direction and a return stroke wherein said reactant element moves in the opposite direction toward said stream and enters the latter, and (2) during each oscillatory cycle thereof to effect controlled incremental rotational movement of said sprinkler body in one direction, a reversing arm mounted with respect to said sprinkler body for movement between operative and inoperative positions, coanda-effect surface means on said reversing arm (1) operable to be disposed out of engagement with a stream issuing from said outlet during an initial incremental range of movement of said reversing arm from said inoperative position toward said operative position, and (2) operable to be engaged by the stream issuing from said outlet during an intermediate incremental range of movement of said reversing arm to create a coanda-effect force acting on said reversing arm in a direction to move the same toward said operative position, reversing reactant surface means on said reversing arm (1) operable to be disposed out of engagement with the stream issuing from said outlet during said initial and intermediate incremental ranges of movement of said reversing arm and (2) operable to be engaged by the stream issuing form said outlet during a final incremental range of movement of said reversing arm for establishing (A) a resultant body reversing force component acting through said reversing arm on said sprinkler body in a direction tangential to the rotational axes of said sprinkler body for effecting a reversing rotational movement in the opposite direction and (B) a resultant reversing arm moving force component acting on said reversing arm in a direction to move the same toward and into said operative position; and means (1) operable in response to the movement of said sprinkler body through a first predetermined incremental range of movement in said one direction for enabling said reversing arm to move from said inoperative position into said operative position, and (2) operable in response to the movement of said sprinkler body through a second predetermined incremental range of movement in said opposite direction for enabling said reversing arm to move from said operative position into said inoperative position.

31. A part-circle sprinkler head as defined in claim 30 wherein said reactant structure includes a thin reactant plate having an edge which constitutes said leading edge, a convexly curved surface extending from said edge which constitutes said coanda-effect surface means and a concavely curved surface extending from said edge which constitutes a part of said reversing reactant surface means.

32. A part-circle sprinkler head as defined in claim 31 wherein said reactant structure further includes a flange portion having a surface constituting a part of said reversing reactant surface means which extends toward and intersects said concavely curved surface along a line extending from side to side thereon from a point adjacent said leading edge to a point remote from said leading edge.

33. A part-circle sprinkler head as defined in claim 32 wherein said convexly curved surface is related to said leading edge such that during the movement of said reversing arm from said inoperative position to said operative position said convexly curved surface will engage the stream before said leading edge.

34. A part-circle sprinkler head as defined in claim 30 wherein spring means is operatively connected with said reversing arm (1) for applying a predetermined spring force on said reversing arm when the latter is in said inoperative position which acts thereon in a direction to stably maintain said reversing arm in said inoperative position and (2) for applying a spring force on said reversing arm which acts in a direction to move said reversing arm toward said inoperative position which decreases in response to the movement of such reversing arm away from said inoperative position toward and into said operative position.

35. A part-circle sprinkler head as defined in claim 34 wherein said reversing arm is pivotally mounted on said sprinkler body for pivotal movement about an axis perpendicular to the pivotal axis of said sprinkler body,said spring means being connected between said sprinkler body and said reversing arm so that the stress force thereof is applied to said reversing arm in spaced relation to its axis when said reversing arm is in said inoperative position, the arrangement being such that the torque applied to said reversing arm as a result of said spring stress force and said space relation decreases as said reversing arm is moved from its inoperative position toward its operative position by virtue of the decrease in said spaced relation notwithstanding an increase in said spring stress force.

36. A part-circle sprinkler head as defined in claim 30 wherein said reversing reactant surface means is provided on a reactant structure mounted on said reversing arm for resilient yielding movement into different operative positions corresponding to and determined by the energy level of the stream engaging said reversing reactant surface means, the particular operative position of said reactant structure causing the resultant body reversing force component established by engagement of the stream with said reversing reactant surface means to remain generally constant throughout a relatively wide range of energy levels in said stream.

37. A part-circle sprinkler head as defined in claim 36 wherein said reversing arm is pivotally mounted on said sprinkler body for pivotal movement about an axis perpendicular to the pivotal axis of said sprinkler body, said reactant structure including an arm section pivotally mounted on said reversing arm for pivotal movement about an axis perpendicular to the axis of pivotal movement of said reversing arm from a spring biased limiting position into different operative positions spaced therefrom and spring means between said reversing arm and said arm section resiliently urging the latter into said spring biased limiting position.

38. A part circle sprinkler head comprising a sprinkler body having an inlet and an outlet, means for mounting said sprinkler body for controlled rotational movement about a generally vertical axis with said inlet in communication with a conduit arranged to communicate a source of water under pressure therewith, said outlet being disposed to direct water under pressure communicated with said inlet in a stream flowing therefrom in a direction upwardly and outwardly in generally symmetrical relation to a plane passing through the axis of rotation, an impulse arm pivotally mounted with respect to said sprinkler body for oscillatory movement and having a reactant element thereon, said impulse arm being normally biased into a limiting position wherein said reactant element is disposed within the path of a stream issuing from said outlet and having means thereon operable (1) in response to the energy of a stream issuing from said outlet to move through repeated oscillatory cycles each of which includes an impulse stroke wherein said reactant element leaves the stream and moves away from the latter in one direction and a return stroke wherein said reactant element moves in the opposite direction toward said stream and enters the latter, and (2) during each oscillatory cycle thereof to effect controlled incremental rotational movement of said sprinkler body in one direction;

a reversing arm mounted with respect to said sprinkler body for movement between operative and inoperative positions;

reversing reactant surface means on said reversing arm engageable by a stream issuing from said outlet when said reversing arm is disposed in said operative position for establishing (1) a resultant body reversing force component acting through said reversing arm on said sprinkler body in a direction tangential to the rotational axis of said sprinkler body for effecting a reversing rotational movemmt in the opposite direction and (2) a resultant reversing arm moving force component acting on said reversing arm in a direction to move the same toward and into said operative position, spring means operatively connected with said reversing arm (1) for applying a predetermined spring force on said reversing arm when the latter is in said inoperative position which acts thereon in a direction to stably maintain said reversing arm in said inoperative position and (2) for applying a spring force on said reversing arm which acts in a direction to move said reversing arm toward said inoperative position which decreases in response to the movement of such reversing arm away from said inoperative position toward and into said operative position, and means (1) operable in response to the movement of said sprinkler body through a first predetermined incremental range of movement in said one direction for enabling said reversing arm to move from said inoperative position into said operative position, and (2) operable in response to the movement of said sprinkler body through a second predetermined incremental range of movement in said opposite direction for enabling said reversing arm to move from said operative position into said inoperative position.

39. A part-circle sprinkler head as defined in claim 38 wherein said reversing arm is pivotally mounted on said sprinkler body for pivotal movement about an axis perpendicular to the pivotal axis of said sprinkler body, said spring means being connected between said sprinkler body and said reversing arm so that the stress force thereof is applied to said reversing arm in spaced relation to its axis when said reversing arm is in said inoperative position, the arrangement being such that the torque applied to said reversing arm as a result of said spring stress force and said spaced relation decreases as said reversing arm is moved from its inoperative position toward its operative position by virtue of the decrease in said spaced relation notwithstanding an increase in said spring stress force.

40. A part-circle sprinkler head as defined in claim 38 wherein said reversing reactant surface means is provided on a reactant structure mounted on said reversing arm for resilient yielding movement into different operative positions corresponding to and determined by the energy level of the stream engaging said reversing reactant surface means, the particular operative position of said reactant structure causing the resultant body reversing force component established by engagement of the stream with said reversing reactant surface means to remain generally constant throughout a relatively wide range of energy levels in said stream.

41. A part-circle sprinkler head as defined in claim 40 wherein said reversing arm is pivotally mounted on said sprinkler body for pivotal movement about an axis perpendicular to the pivotal axis of said sprinkler body, said reactant structure including an arm section pivotally mounted on said reversing arm for pivotal movement about an axis perpendicular to the axis of pivotal movement of said reversing arm from a spring biased limiting position into different operative positions spaced therefrom and spring means between said reversing arm and said arm section resiliently urging the latter into said spring biased limiting position.

* * * * *